US010752466B2

(12) United States Patent
Jedryczka et al.

(10) Patent No.: US 10,752,466 B2
(45) Date of Patent: Aug. 25, 2020

(54) TRANSFER STATION FOR A ROPELESS ELEVATOR SYSTEM WITH REDUNDANCY OF SUBCOMPONENTS AND PARKING ZONE

(71) Applicant: OTIS ELEVATOR COMPANY, Farmington, CT (US)

(72) Inventors: Cezary Jedryczka, Lniano (PL); Adam Marian Myszkowski, Ostrow Wlkp (PL); Tadeusz Witczak, Farmington, CT (US); Zbigniew Piech, Cheshire, CT (US); Bruce P. Swaybill, Farmington, CT (US); Wojciech Szelag, Poznan (PL); Arthur Hsu, South Glastonbury, CT (US); Enrico Manes, Feeding Hills, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 271 days.

(21) Appl. No.: 15/539,952

(22) PCT Filed: Dec. 22, 2015

(86) PCT No.: PCT/US2015/067377
§ 371 (c)(1),
(2) Date: Jun. 26, 2017

(87) PCT Pub. No.: WO2016/109338
PCT Pub. Date: Jul. 7, 2016

(65) Prior Publication Data

US 2018/0009636 A1 Jan. 11, 2018

Related U.S. Application Data

(60) Provisional application No. 62/098,028, filed on Dec. 30, 2014.

(51) Int. Cl.
*B66B 9/00* (2006.01)
*B66B 11/00* (2006.01)
*B66B 11/04* (2006.01)

(52) U.S. Cl.
CPC ..... *B66B 9/003* (2013.01); *B66B 11/0005* (2013.01); *B66B 11/0407* (2013.01)

(58) Field of Classification Search
CPC ..... B66B 9/003
See application file for complete search history.

(56) References Cited

U.S. PATENT DOCUMENTS 633,215 A * 9/1899 Poulson ..... B66B 9/003 198/798
1,859,483 A 5/1932 Winslow
(Continued)

FOREIGN PATENT DOCUMENTS

CN 101875465 A 11/2010
JP 03177290 8/1991
(Continued)

OTHER PUBLICATIONS

International Search Report regarding related PCT App. No. PCT/US2015/067827; dated May 12, 2016; 6 pgs.
(Continued)

*Primary Examiner* — Diem M Tran
(74) *Attorney, Agent, or Firm* — Cantor Colburn LLP

(57) ABSTRACT

A transfer station (40) for a ropeless elevator system hoistway (11) is provided. The transfer station (40) includes a first lane (13, 15, 17), a second lane (13, 15, 17), and a parking area (42) located proximate one of the first lane (13, 15, 17) and the second lane (13, 15, 17). The transfer station (40) also includes a plurality of carriages (46) moveable within the first lane (13, 15, 17), the second lane (13, 15, 17), and the parking area (42), the plurality of carriages (46) config-
(Continued)

ured to support and move an elevator car (14). The transfer station (40) further includes a cassette (44) configured to support and move the plurality of carriages (46). The transfer station (40) yet further includes a guiding member (48) engaged with the cassette (44), wherein the position of each of the plurality of carriages (46) relative to the first lane (13, 15, 17), the second lane (13, 15, 17) and the parking area (42) is modified by horizontal or vertical movement of the cassette (44).

8 Claims, 5 Drawing Sheets

(56) References Cited

U.S. PATENT DOCUMENTS

| | | | | |
|---|---|---|---|---|
| 3,317,005 | A | 5/1967 | Kehoe | |
| 3,658,155 | A | 4/1972 | Salter | |
| 9,016,438 | B2 | 4/2015 | Altenburger et al. | |
| 9,248,994 | B2 * | 2/2016 | Grundmann | B66B 9/00 |
| 2003/0217893 | A1 | 11/2003 | Dunser et al. | |
| 2011/0132693 | A1 | 6/2011 | Altenburger | |
| 2016/0152446 | A1 * | 6/2016 | Dudde | B66B 9/003 187/249 |
| 2017/0362061 | A1 | 12/2017 | Witczak et al. | |
| 2019/0077636 | A1 * | 3/2019 | Bhaskar | B66B 9/003 |

FOREIGN PATENT DOCUMENTS

| | | | |
|---|---|---|---|
| JP | H04153187 | A | 5/1992 |
| JP | 05147857 | | 6/1993 |
| WO | 2012154178 | A1 | 11/2012 |
| WO | 2016109511 | A1 | 7/2016 |

OTHER PUBLICATIONS

Written Opinion regarding related PCT App. No. PCT/US2015/067827; dated May 12, 2016; 6 pgs.
English translation of Office Action regarding related CN App. No. 201580072078.7, dated Sep. 3, 2018, 9 pgs.
International Search Report regarding related PCT App. No. PCT/US2015/067377; dated Apr. 12, 2016; 6 pgs.
Written Opinion regarding related PCT App. No. PCT/US2015/067377; dated Apr. 12, 2016; 6 pgs.
Non Final Office Action for U.S. Appl. No. 15/539,967, dated Jun. 26, 2017, 20 pages.

* cited by examiner

TRANSFER STATION FOR A ROPELESS ELEVATOR SYSTEM WITH REDUNDANCY OF SUBCOMPONENTS AND PARKING ZONE

CROSS-REFERENCE TO RELATED APPLICATIONS

This patent application is a National Stage Application of International Patent Application Serial No. PCT/US2015/067377, filed Dec. 22, 2015, which claims priority to U.S. Provisional Patent Application Ser. No. 62/098,028, filed Dec. 30, 2014, which are incorporated herein by reference in their entirety.

FIELD OF THE INVENTION

The subject matter disclosed herein relates generally to the field of elevators, and more particularly to a multicar, ropeless elevator system.

BACKGROUND OF THE INVENTION

Ropeless elevator systems, also referred to as self-propelled elevator systems, are useful in certain applications (e.g., high rise buildings) where the mass of the ropes for a roped system is prohibitive and there is a desire for multiple elevator cars to travel in a single lane. There exist ropeless elevator systems in which a first lane is designated for upward traveling elevator cars and a second lane is designated for downward traveling elevator cars with at least two transfer stations in the hoistway used to move cars horizontally between the first lane and second lane.

Transfer stations do not typically provide redundancy for transfer station operation. Therefore, the numbers of structures capable of moving elevator cars is equal to or lower than the number of lanes of the hoistway. The assumption is that in a worst case scenario, independent working carriages in the transfer station may work with a reduced number of carriages. Working with a reduced number of carriages decreases overall elevator system efficiency and may cause operation delays, as well as logistical challenges.

BRIEF DESCRIPTION OF THE INVENTION

According to one aspect of the invention, a transfer station for a ropeless elevator system hoistway is provided. The transfer station includes a first lane, a second lane, and a parking area located proximate one of the first lane and the second lane. The transfer station also includes a plurality of carriages moveable within the first lane, the second lane, and the parking area, the plurality of carriages configured to support and move an elevator car. The transfer station further includes a cassette configured to support and move the plurality of carriages. The transfer station yet further includes a guiding member engaged with the cassette, wherein the position of each of the plurality of carriages relative to the first lane, the second lane and the parking area is modified by horizontal or vertical movement of the cassette.

In addition to one or more of the features described above, or as an alternative, further embodiments may include that the guiding member comprises a guide rail.

In addition to one or more of the features described above, or as an alternative, further embodiments may include a linear motor operatively coupled to the cassette for imparting movement of the cassette along the guiding member.

In addition to one or more of the features described above, or as an alternative, further embodiments may include that the number of the plurality of carriages is equal to the number of hoistway lanes.

In addition to one or more of the features described above, or as an alternative, further embodiments may include that the number of the plurality of carriages of the transfer station cassette is less than the number of hoistway lanes.

In addition to one or more of the features described above, or as an alternative, further embodiments may include that at least a portion of the cassette is always located in the parking area.

In addition to one or more of the features described above, or as an alternative, further embodiments may include an additional cassette comprising a plurality of additional carriages positioned therein, the additional cassette moveable between a first position and a second position, the first position defined by all of the plurality of additional carriages being located within the parking area, the second position defined by at least one of the plurality of additional carriages being located within at least one of the first lane and the second lane.

In addition to one or more of the features described above, or as an alternative, further embodiments may include that the cassette and the additional cassette are interchangeable within the hoistway.

In addition to one or more of the features described above, or as an alternative, further embodiments may include that each of the plurality of carriages are replaceable while positioned in the parking area.

According to another aspect of the invention, a transfer station for a ropeless elevator system hoistway is provided. The transfer station includes a first lane, a second lane, and a parking area located proximate one of the first lane and the second lane. The transfer station also includes a transfer station carriage comprising a frame to support and move an elevator car between the first lane, the second lane and the parking area. The transfer station further includes a guiding member engaged with the transfer station carriage.

In addition to one or more of the features described above, or as an alternative, further embodiments may include that the guiding member comprises a guide rail.

In addition to one or more of the features described above, or as an alternative, further embodiments may include a linear motor operatively coupled to the transfer station carriage for imparting movement of the transfer station carriage along the guiding member.

In addition to one or more of the features described above, or as an alternative, further embodiments may include that the transfer station carriage includes a fixed power source.

In addition to one or more of the features described above, or as an alternative, further embodiments may include that the elevator car is configured to vertically pass through at least one of the transfer station cassette and the transfer station carriage.

In addition to one or more of the features described above, or as an alternative, further embodiments may include that the transfer station carriage is moveable in a horizontal direction between the first lane, the second lane and the parking area.

In addition to one or more of the features described above, or as an alternative, further embodiments may include that the carriages located in the cassette may move in up to three directions if engaged with the transfer station cassette.

In addition to one or more of the features described above, or as an alternative, further embodiments may include that the carriage is used as a temporary parking station for the elevator car.

In addition to one or more of the features described above, or as an alternative, further embodiments may include that the carriage is used as a long-term parking station for the elevator car.

In addition to one or more of the features described above, or as an alternative, further embodiments may include that the elevator car is removed from the lanes within the transfer station carriage.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
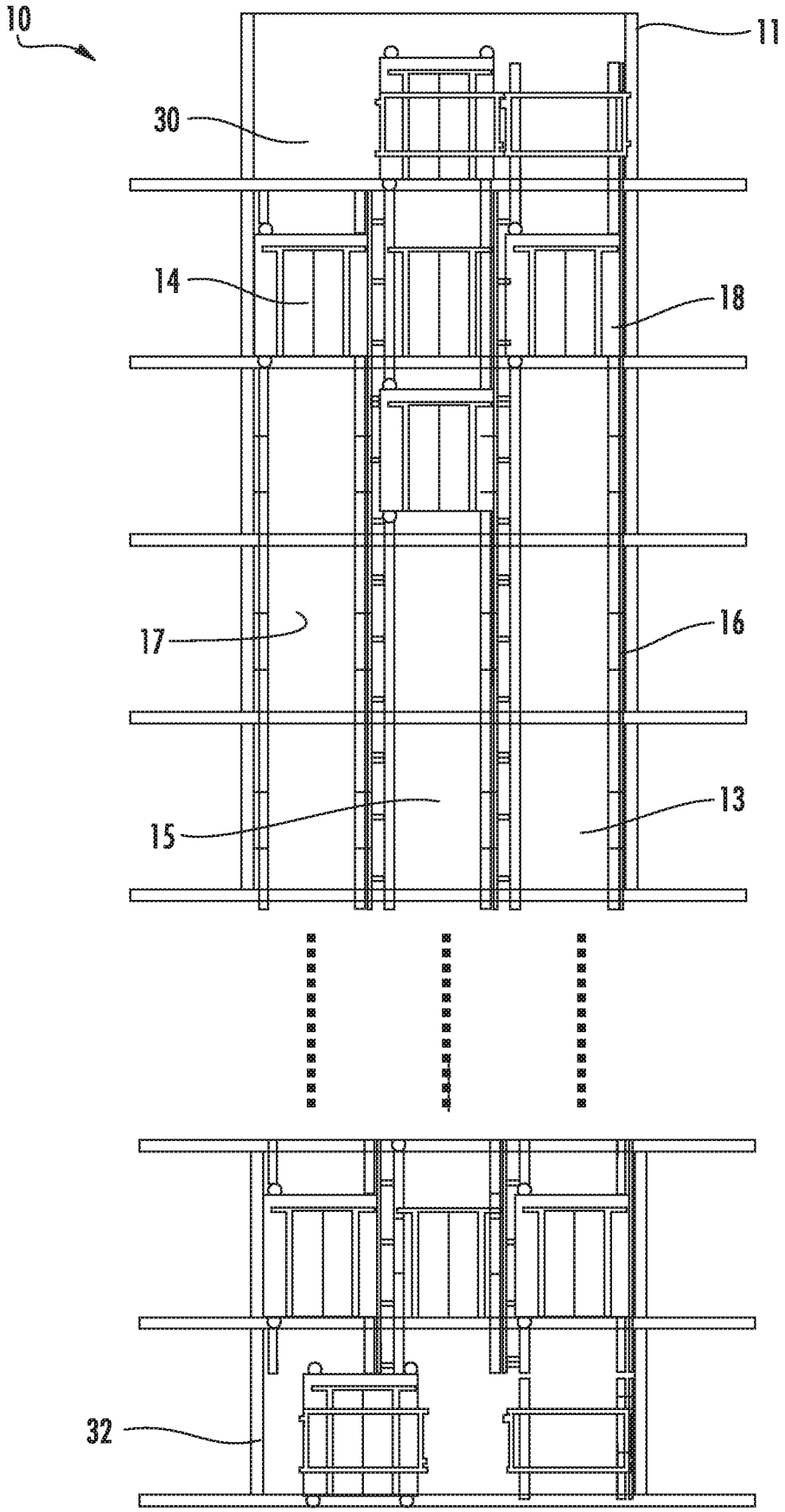
FIG. 1 illustrates a multicar ropeless elevator system according to one aspect of the invention.

Referring to FIG. 1, a multicar, ropeless elevator system 10 is illustrated according to one embodiment. Elevator system 10 includes a hoistway 11 having a plurality of lanes 13, 15 and 17. While three lanes are shown in FIG. 1, it is understood that embodiments may be used with multicar, ropeless elevator systems that have any number of lanes. In each lane 13, 15, 17, cars 14 travel in one direction, i.e., up or down. For example, in FIG. 1 cars 14 in lanes 13 and 17 travel up and cars 14 in lane 15 travel down. One or more cars 14 may travel in a single lane 13, 15, and 17.

Above the top floor is an upper transfer station 30 to impart horizontal motion to elevator cars 14 to move elevator cars 14 between lanes 13, 15 and 17. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the lower and the upper transfer station floors. Intermediate transfer stations are similar to the upper transfer station 30 and lower transfer station 32. Additionally, both the upper transfer station 30 and the lower transfer station 32 may be at system terminals, or at any floor above or below. Therefore, it is to be understood that an upper transfer station is meant to be the highest placed transfer station in the loop and a bottom transfer station is the lowest transfer station in the loop. Transfer stations at various locations advantageously impact the functional capability of the system by increasing loop options. For example, the lanes may include cars traveling in a unidirectional or bidirectional manner. Furthermore, parking of the cars may be performed in transfer stations depending on the particular location and configuration.

Cars 14 are self-propelled using, for example, a linear motor system having a fixed portion 16 and a moving portion 18. One or more fixed portions 16 are mounted in lanes 13, 15 and 17. One or more moving portions 18 are mounted on cars 14. One of the motor portions is supplied with drive signals to control movement of cars 14 in their respective lanes.

Figure 2:
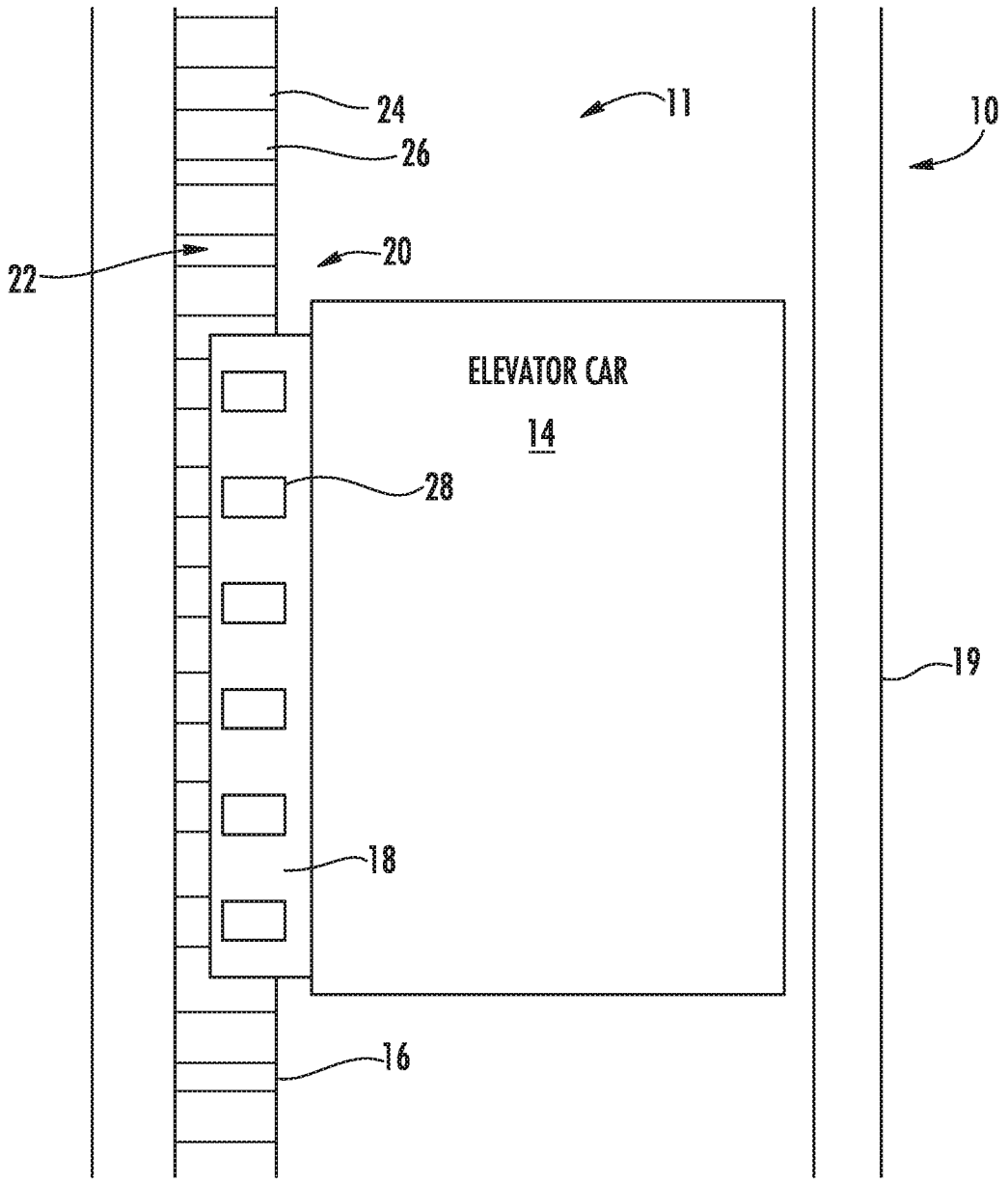
FIG. 2 is a schematic illustration of one car of the multicar ropeless elevator system.

Referring to FIG. 2, illustrated is another view of the elevator system 10 including an elevator car 14 that travels in hoistway 11. Elevator car 14 is guided by one or more guide structure 24 extending along the length of hoistway 11, where the guide structure 24 may be affixed to hoistway wall, propulsion device, carriage structural member 19, or stacked over each other. For ease of illustration, the view of FIG. 2 only depicts a single side guide structure 24; however, there may be two or more guide structure 24 positioned, for example, on opposite sides of the elevator car 14. Elevator system 10 employs a vertical propulsion system 20, where same placement variations apply to vertical propulsion stationary portion 16 placed in the hoistway 11. Vertical propulsion stationary portion 16 includes multiple segments 22. Segments 22 may be affixed to hoistway wall, guide structure, carriage structural member 19, or stacked over each other. Propulsion moving portion 18 may be affixed to a car frame or be a structural member of a car frame. A number of propulsion moving portions 18 may be placed on a car 14.

Referring now to FIGS. 3-6, with continued reference to FIG. 1, a transfer station 40 is illustrated. The illustrated transfer station 40 may be positioned at any vertical location within the hoistway 11. For example, the transfer station 40 may be the upper transfer station 30, the lower transfer station 32, or an intermediate transfer station located between two of them.

As described above, the transfer station 40 is a location where the elevator cars 14 may be moved (horizontally and/or vertically) to transfer the cars 14 between the lanes 13, 15, 17 and between a parking and/or storage area 42. Each transfer station may have adjacent storage or parking areas for carriages. Transport of the cars is made with a frame-like structure referred to as a carriage 46. Structures moving relative to the hoistway having their own propulsion system and that allow carriages 46 to be stored therein will be referred to herein as a cassette 44. Additionally, the cassette 44 allows the carriages 46 to move relative to the cassette structure itself. When cassettes are a duplication of a working transfer station beneath the lanes they may become redundant transfer stations, as shown in FIGS. 3 and 4.

The carriages 46 placed in the cassette 44 may be used to park or store elevator cars 14 in a manner that allows disengagement of the cars from the guiding structures within the hoistway. The carriages are moved out of the lanes 13, 15, 17. Parking of the cars 14 may be done for varied amounts of time. Additionally, the carriages 46 and/or cars 14 parked in the cassette 44 are located where maintenance of the cars 14 and/or carriages 46 may be conducted. It is to be understood that although a single parking area 42 is discussed, multiple parking areas 42 may be included at each transfer station 40. For example, a parking area 42 may be located adjacent more than one of the lanes 13, 15, 17. Furthermore, the position of the cassette 44 may vary, such that one embodiment has the cassette 44 located to the side of the lanes (FIGS. 5 and 6), while another embodiment has a parking area located in front or aft of the lanes (FIGS. 3 and 4). The layout of the cassette 44 may vary as well. For example, the cassette 44 may be oriented vertically and adjacent to the hoistway (variation of system shown on FIG. 5). These are merely examples and it is to be appreciated that numerous other layouts are contemplated.

Figure 6:
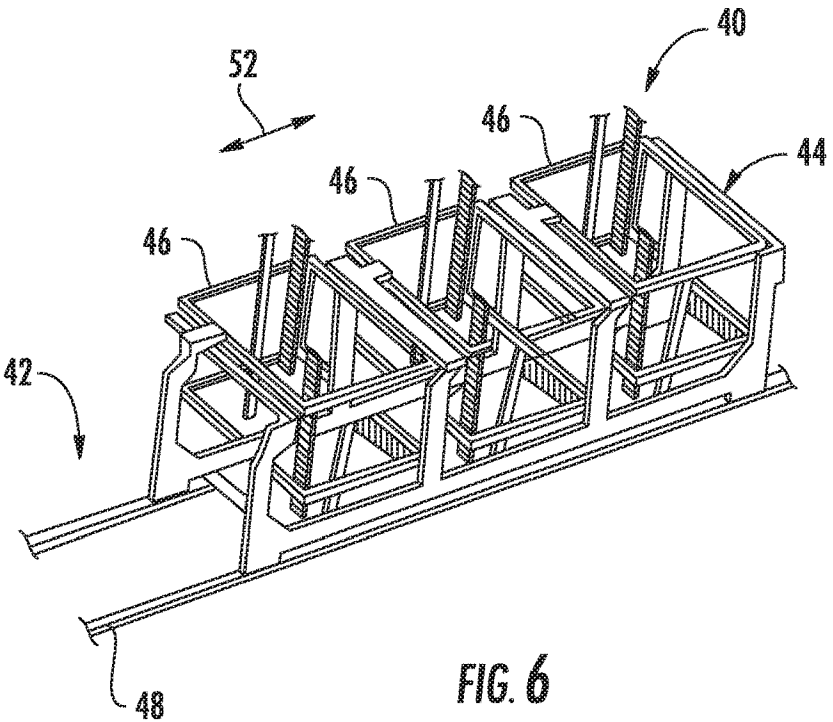
FIG. 6 is a perspective view of the transfer station carriage cassette according to the embodiment of FIG. 5.
Figure 5:
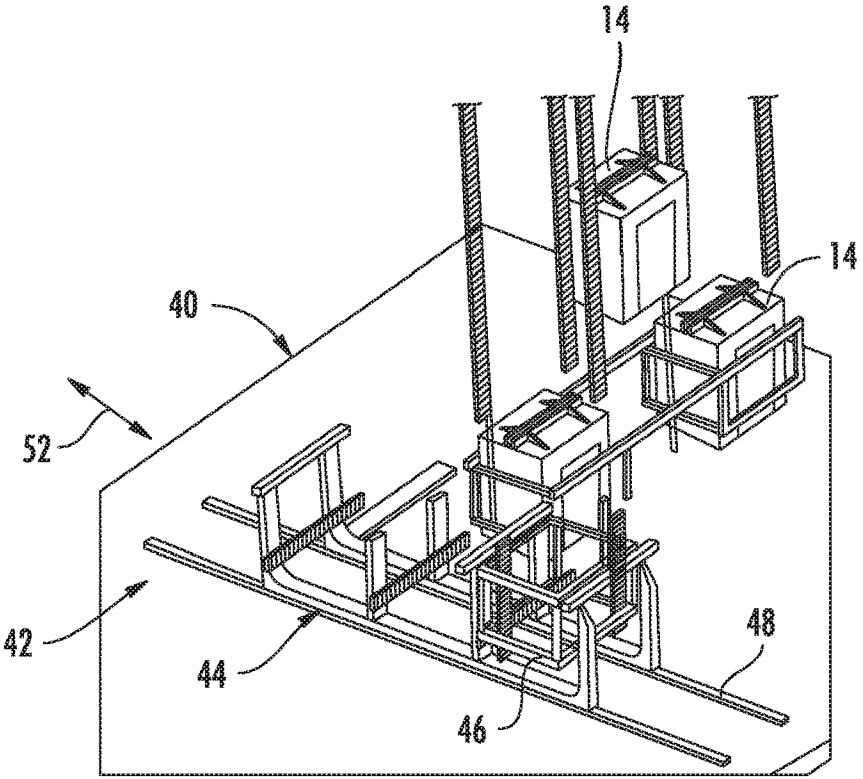
FIG. 5 is a perspective view of a transfer station with carriage cassette for the multicar ropeless elevator system according to another embodiment.

In one embodiment, the carriages 46 are moved, with or without an elevator car 14 therein, to a cassette 44 located completely out of vertical alignment with the lanes, as shown in FIGS. 5 and 6. In the illustrated embodiment, the cassette 44 slides back and forth in a direction parallel to a second axis 52. In the illustrated embodiment, the cassette 44 is moveable between a position in alignment with the lanes 13, 15, 17 and a parking area located on either side, or both sides of the lanes for parking of the carriages 46. In such an embodiment, the cassette 44 may include any number of carriages 46 positioned therein. For example, an embodiment that includes a number of carriages 46 that is greater than the number of lanes would allow at least one of the plurality of carriages 46 to always be located in the parking area cassette 42.

Figure 4:
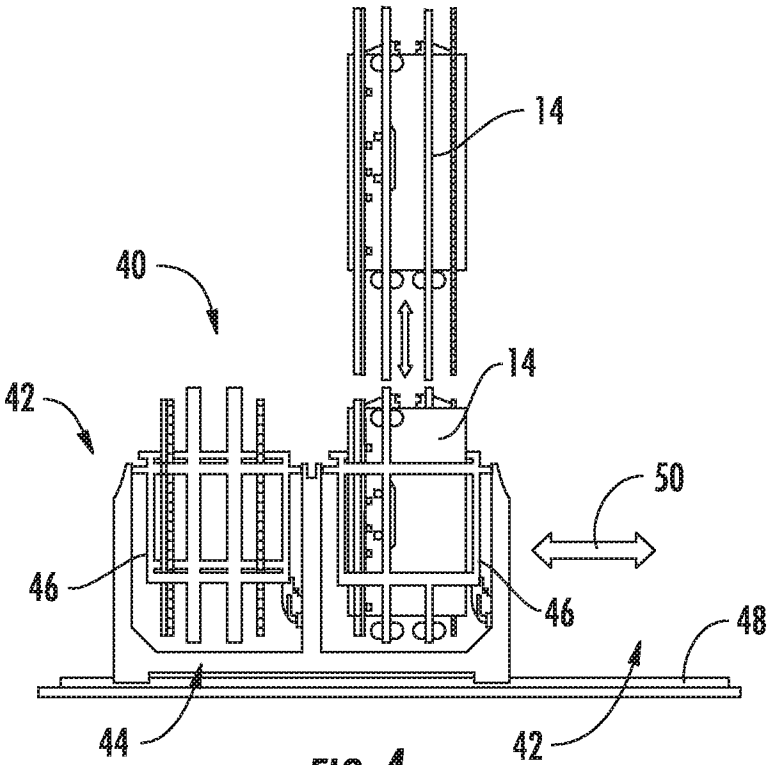
FIG. 4 is an elevation view of the cassette transfer station according to the embodiment of FIG. 3.
Figure 3:
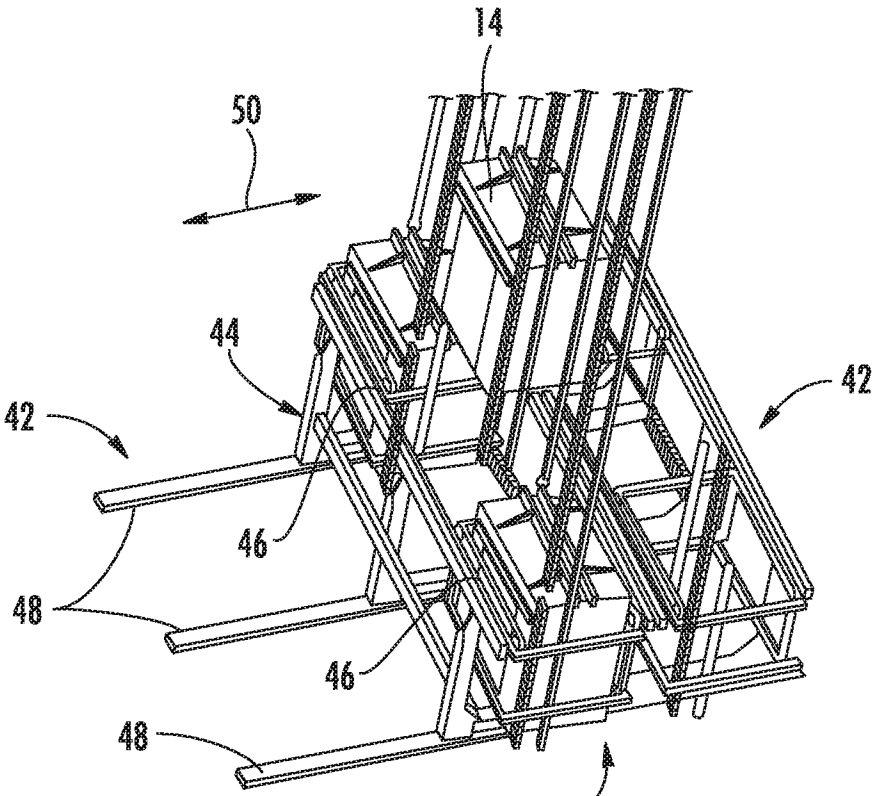
FIG. 3 is a perspective view of a cassette transfer station of the multicar ropeless elevator system according to one embodiment.

In another embodiment, the cassette 44 itself is vertically aligned with the lanes and is configured to move relative to the hoistway to maneuver the carriages 46 stored therein, as shown in FIGS. 3 and 4. In the embodiment illustrated in FIGS. 3 and 4, the cassette 44 slides back and forth in a direction parallel to a first axis 50. In the illustrated embodiment, the transfer station cassette 44 is moveable between a position in alignment with the lanes 13, 15, 17 and a parking area 42 located in front and/or aft of the lanes. In such an embodiment, the cassette 44 typically includes a number of carriages 46.

In the embodiment of FIGS. 3 and 4, the cassette 44 is moveable in a horizontal and/or vertical direction in a way that allows the elevator cars 14 loaded within the carriages 46 to be moved to and from the lanes 13, 15, 17 and the parking area 42. The horizontal movement is facilitated by a guiding member 48 that is engaged with the transfer station cassette 44. The guiding member 48 is a guide rail or a similar structural element that is configured to direct the movement of the transfer station cassette 44. Propulsion of the cassette 44 along the guiding member 48 may be achieved in a number of ways. For example, a linear motor, belt, or chain may be employed.

As described above, the number of carriages 46 that may be held in cassette 44 may vary, with the number of carriages 46 less than or equal to the number of lanes served in the hoistway.

In any of the above-described embodiments of the transfer station 40, an enhanced level of redundancy and ease of maintenance is obtained. This is attributed to the possibility to include additional carriages that may quickly be deployed to a position aligned with one of the lanes of the hoistway 11. Therefore, if one of the carriages requires maintenance or replacement, the cassette 44 may simply be maneuvered to reposition the carriages 46. This allows the carriage requiring maintenance or replacement to be either moved to the cassette 44 (FIGS. 5. and 6), while another functioning carriage is repositioned into the lane for use with elevator cars that require horizontal repositioning or shifting the cassette 44 (FIGS. 3 and 4) and replacing the current transfer station with full functional redundant one. Movement of the cars 14 to other lanes and/or the parking area within the carriages 46 facilitates rapid repositioning of the car 14 while other cars pass through the lane in an unimpeded manner.

The embodiments described above not only provide the ability to perform maintenance and replace single carriages while in the parking area. In some embodiments, an additional transfer station cassette having an additional plurality of carriages is included to provide redundancy of an entire transfer station. In such embodiments, the additional cassette stands by in a stand by zone and is interchangeable with the cassette 44, thereby providing an additional layer of redundancy for the system 10 (FIGS. 3. and 4.).

Figure 7:
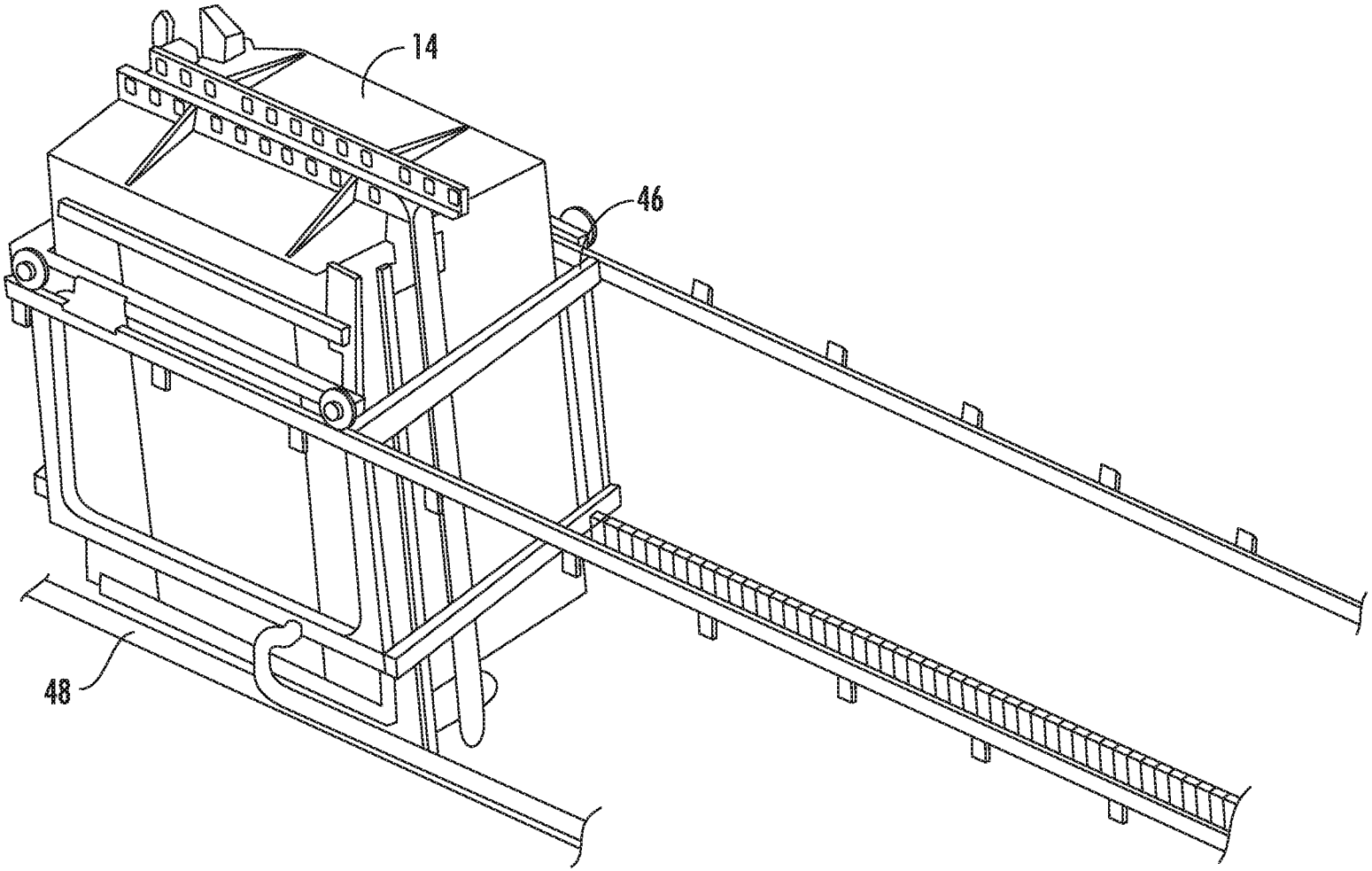
FIG. 7 is a perspective view of a transfer station carriage of the multicar ropeless elevator system.

The single carriage embodiment illustrated in FIG. 7 depicts a carriage that is able to perform the tasks described above. Namely, supporting and repositioning the elevator cars 14 in a desirable manner allowing cars to circulate between the lanes, thereby increasing overall efficiency of the elevator system 10. It is to be appreciated that with a single carriage embodiment, the car may be supported within the carriage to move vertically, in addition to horizontally.

In any of the above-described embodiments, the carriages may be configured to allow the elevator cars 14 to pass through the frame-like structures, such that the carriages may be positioned in the middle lanes during normal operation of the elevator system 10. This alleviates the need to maintain the carriages out of the lanes until they are needed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A transfer station for a ropeless elevator system hoistway comprising:

a first lane;

a second lane;

a parking area located proximate one of the first lane and the second lane;

a plurality of carriages moveable within the first lane, the second lane, and the parking area, the plurality of carriages configured to support and move an elevator car, each of the plurality of carriages configured to allow the elevator car to move in and out of the carriage;

a cassette configured to support and move the plurality of carriages; and a guiding member engaged with the cassette, wherein the position of each of the plurality of carriages relative to the first lane, the second lane and the parking area is modified by horizontal or vertical movement of the cassette;

an additional cassette comprising a plurality of additional carriages positioned therein, the additional cassette moveable between a first position and a second position, the first position defined by all of the plurality of additional carriages being located within the parking area, the second position defined by at least one of the plurality of additional carriages being located within at least one of the first lane and the second lane.

2. The transfer station of claim 1, wherein the guiding member comprises a guide rail.

3. The transfer station of claim 1, further comprising a linear motor operatively coupled to the cassette for imparting movement of the cassette along the guiding member.

4. The transfer station of claim 1, wherein the number of the plurality of carriages is equal to the number of hoistway lanes.

5. The transfer station of claim 1, wherein the number of the plurality of carriages of the transfer station cassette is less than the number of hoistway lanes.

6. The transfer station of claim 5, wherein at least a portion of the cassette is always located in the parking area.

7. The transfer station of claim 1, wherein the cassette and the additional cassette are interchangeable within the hoistway.

8. The transfer station of claim 1, wherein each of the plurality of carriages are replaceable while positioned in the parking area.

* * * * *